US012601362B2

(12) United States Patent
Qian

(10) Patent No.: US 12,601,362 B2
(45) Date of Patent: Apr. 14, 2026

(54) CENTRIFUGAL FAN FRAME STRUCTURE

(71) Applicant: ASIA VITAL COMPONENTS (CHINA) CO., LTD., Shenzhen (CN)

(72) Inventor: Jin Qian, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 0 days.

(21) Appl. No.: 17/385,921

(22) Filed: Jul. 27, 2021

(65) Prior Publication Data

US 2023/0003230 A1 Jan. 5, 2023

(30) Foreign Application Priority Data

Jul. 2, 2021 (CN) ..... 202110750620.7

(51) Int. Cl.
*F04D 29/42* (2006.01)

(52) U.S. Cl.
CPC ..... *F04D 29/4226* (2013.01)

(58) Field of Classification Search
CPC ..... F04D 29/4226; F04D 29/582
See application file for complete search history.

(56) References Cited

U.S. PATENT DOCUMENTS

2007/0251677 A1* 11/2007 Hwang ..... F04D 29/4226 257/722
2012/0002368 A1* 1/2012 Broili ..... F04D 25/066 361/679.48
2013/0171014 A1 7/2013 Horng
2021/0317844 A1* 10/2021 Chen ..... F04D 29/281

FOREIGN PATENT DOCUMENTS

CN 102022382 A 4/2011
CN 102086962 A 6/2011
CN 102782605 A 11/2012
CN 202833224 U 3/2013
CN 103790864 A 5/2014
(Continued)

OTHER PUBLICATIONS

Search Report dated Jan. 25, 2022 issued by Taiwan Intellectual Property Office for counterpart application No. 110124472.
(Continued)

*Primary Examiner* — Courtney D Heinle
*Assistant Examiner* — Andrew Thanh Bui
(74) *Attorney, Agent, or Firm* — Bradley J. Thorson; DeWitt LLP

(57) ABSTRACT

A centrifugal fan frame structure includes a base plate and a plurality of side wall sections. The side wall sections are discontinuously formed along an outer periphery of the base plate through injection molding, such that a clearance is formed between any two adjacent side wall sections, and portions of the outer periphery of the base plate located corresponding to the clearances are not covered by any injection molded side wall section. And, the side wall sections and the base plate together define a receiving space between them. With the injection molded side wall sections being spaced along the outer periphery of the base plate, a wrapping force from the injection molded side wall sections is effectively reduced to prevent the base plate from structural deformation under the wrapping force.

6 Claims, 3 Drawing Sheets

(56) References Cited

FOREIGN PATENT DOCUMENTS

| | | | |
|---|---|---|---|
| CN | 103796483 | A | 5/2014 |
| CN | 106292944 | A | 1/2017 |
| CN | 215719808 | U | 2/2022 |
| JP | 2011247275 | A | 12/2011 |

OTHER PUBLICATIONS

Search Report dated Dec. 19, 2024 issued by China National Intellectual Property Administration for counterpart application No. 202110750620.7.

Search Report dated Dec. 8, 2025, issued by China National Intellectual Property Administration for counterpart application No. 202110750620.7.

* cited by examiner

CENTRIFUGAL FAN FRAME STRUCTURE

This application claims the priority benefit of China patent application number 202110750620.7 filed on Jul. 2, 2021.

FIELD OF THE INVENTION

The present invention relates to a centrifugal fan frame structure, and more particularly, to a centrifugal fan frame structure that reduces a wrapping force applied by injection molded side wall sections to a base plate of the fan frame structure.

BACKGROUND OF THE INVENTION

A centrifugal fan is a very popular systematic fan, which is often applied to an electronic device having a narrow internal space or to an occasion that has to provide an air outlet at a lateral side. Generally, the centrifugal fan has a base made of one single type of plastic material or a thin metal plate. In the case of using a plastic base, it is manufactured through a plastic injection molding process. However, since the plastic base has inferior structural strength, the thin metal plate is usually selected as the material for forming the fan frame base.

The conventional centrifugal fan frame mainly includes two parts, namely, a base formed of a thin metal plate and a side wall formed of a plastic material. Generally, the plastic side wall is wrapped around an outer periphery of the metal base by way of integral injection molding. The plastic injection molded side wall is in a continuously extended configuration, so that the side wall and the base together constitute the centrifugal fan frame. This type of centrifugal fan frame has a problem, namely, the plastic material tends to produce a wrapping force in the process of injection molding. When the side wall is formed along the outer periphery of the metal base by injection molding, the metal base is compressed by the wrapping force from the plastic injection molded side wall and becomes deformed and uneven. In the subsequent assembling process, the deformed base would affect the designed clearance size, horizontality and balance between the fan blades and the base of the centrifugal fan. In a worse condition, the fan performance is also affected due to interference of the fan blades with the base, changes in the relationship between the static pressure (P) and air flow rate (Q) of the fan, changes in produced noise, etc. Therefore, it is necessary to develop a structural design that can resist the deformation of the centrifugal fan frame during the injection molding process.

It is therefore an important target for persons skilled in the art to improve the drawback of the conventional centrifugal fan frame that the plastic injection molded side wall tends to cause deformation of the metal base.

SUMMARY OF THE INVENTION

A primary object of the present invention is to provide a centrifugal fan frame structure, which enables reduced wrapping force injection molded side wall sections of the fan frame structure and prevents a base plate of the fan frame structure from deformation under the wrapping force.

Another object of the present invention is to provide a centrifugal fan frame structure that includes a plurality of spaced side wall sections being formed by injection molding to connect to an outer periphery of a base plate, so that the fan frame structure is protected against deformation in the injection molding process.

To achieve the above and other objects, the centrifugal fan frame structure according to the present invention includes a base plate and a plurality of side wall sections. The side wall sections are discontinuously formed along an outer periphery of the base plate through injection molding, such that a clearance is formed between any two adjacent side wall sections, and portions of the outer periphery of the base plate located corresponding to the clearances are not covered by any injection molded side wall sections. And, the side wall sections and the base plate together define a receiving space between them. With the fan frame structure designed according to the present invention, a wrapping force from the injection molded side wall sections is effectively reduced to prevent the base plate from deformation under the wrapping force, and the entire fan frame structure is also effectively protected against structural deformation in the process of injection molding.

In the present invention, the side wall sections include a plurality of lengthwise extended side wall sections and a plurality of curved side wall sections. The lengthwise extended side wall sections and the curved side wall sections together form a surrounding wall. And, the curved side wall sections are spaced from and not connected to one another.

In the present invention, the base plate and the side wall sections can be made of the same material or be made of different materials. In a preferred embodiment, the side wall sections are made of a plastic material while the base plate is made of a metal material.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
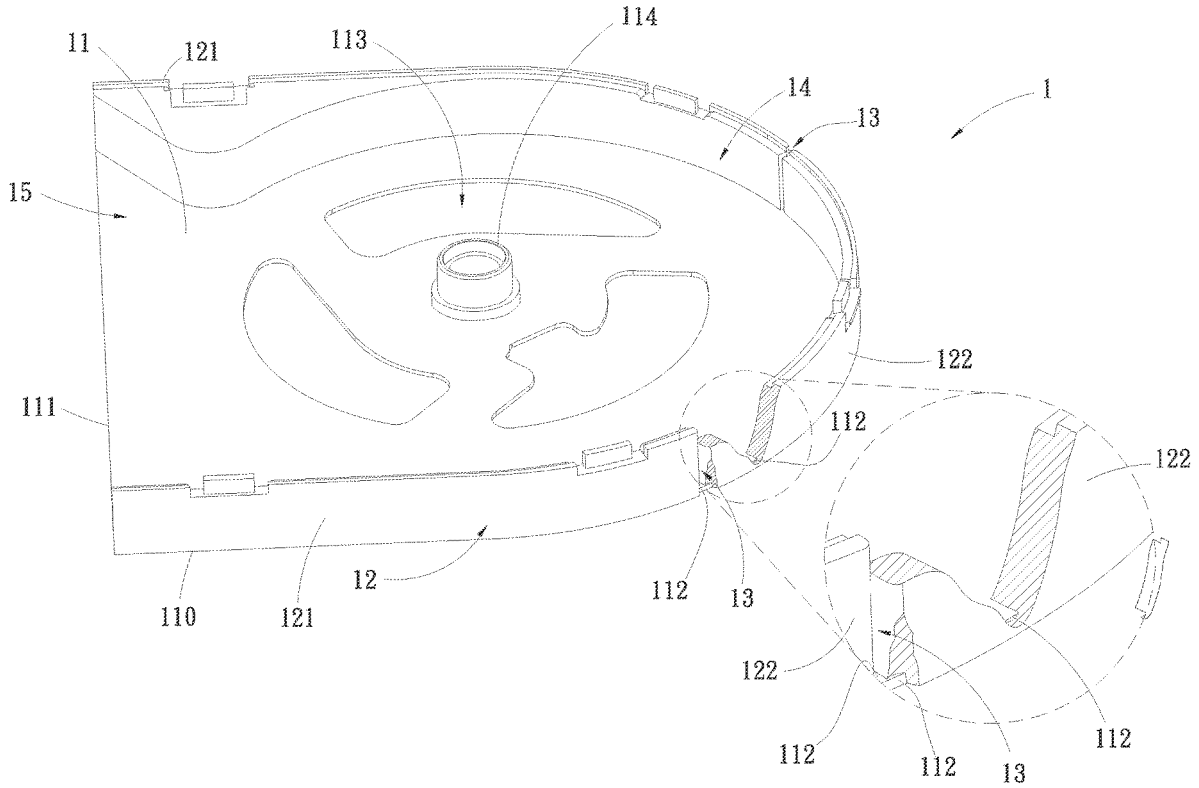
FIG. 1 is a perspective and partially sectioned view of a centrifugal fan frame structure according to a preferred embodiment of the present invention.
Figure 2:
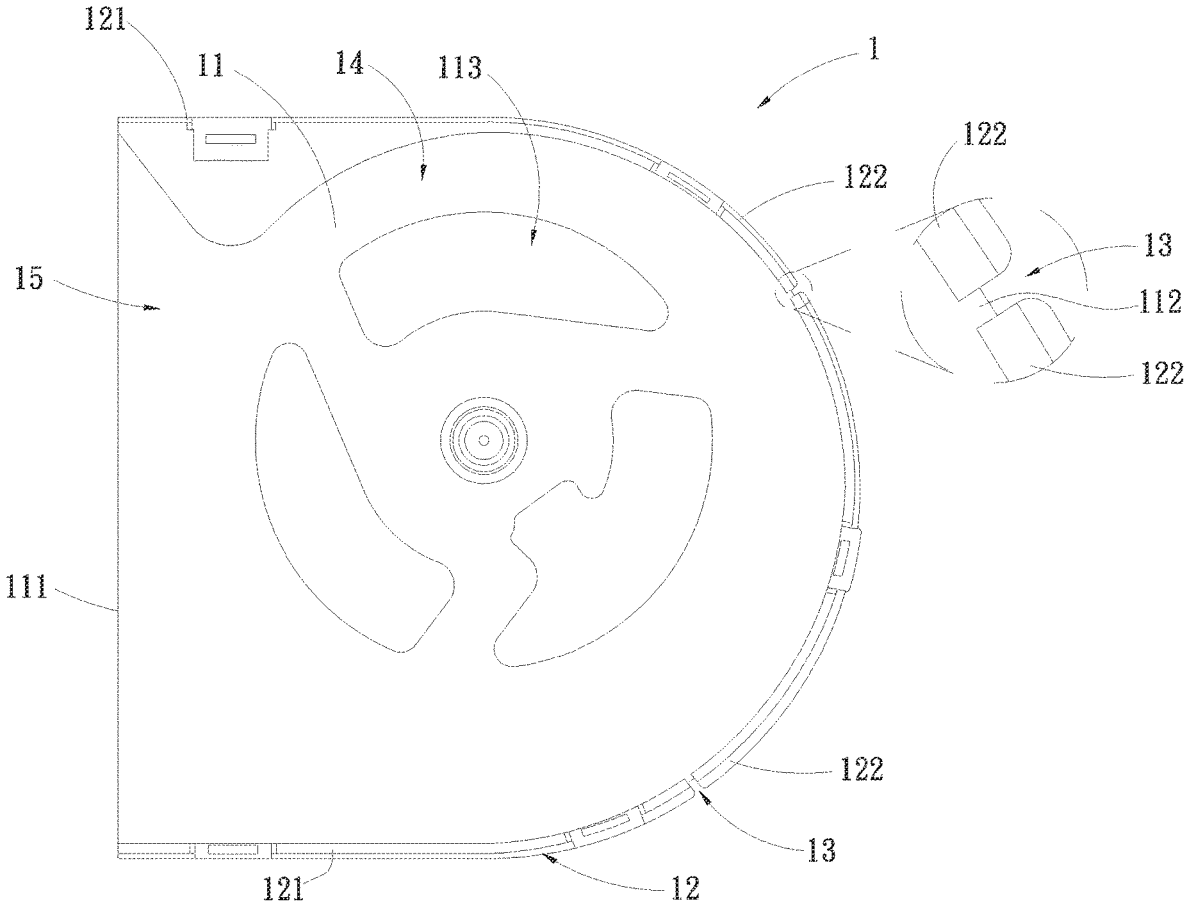
FIG. 2 is a top view of the centrifugal fan frame structure of FIG. 1.
Figure 3:
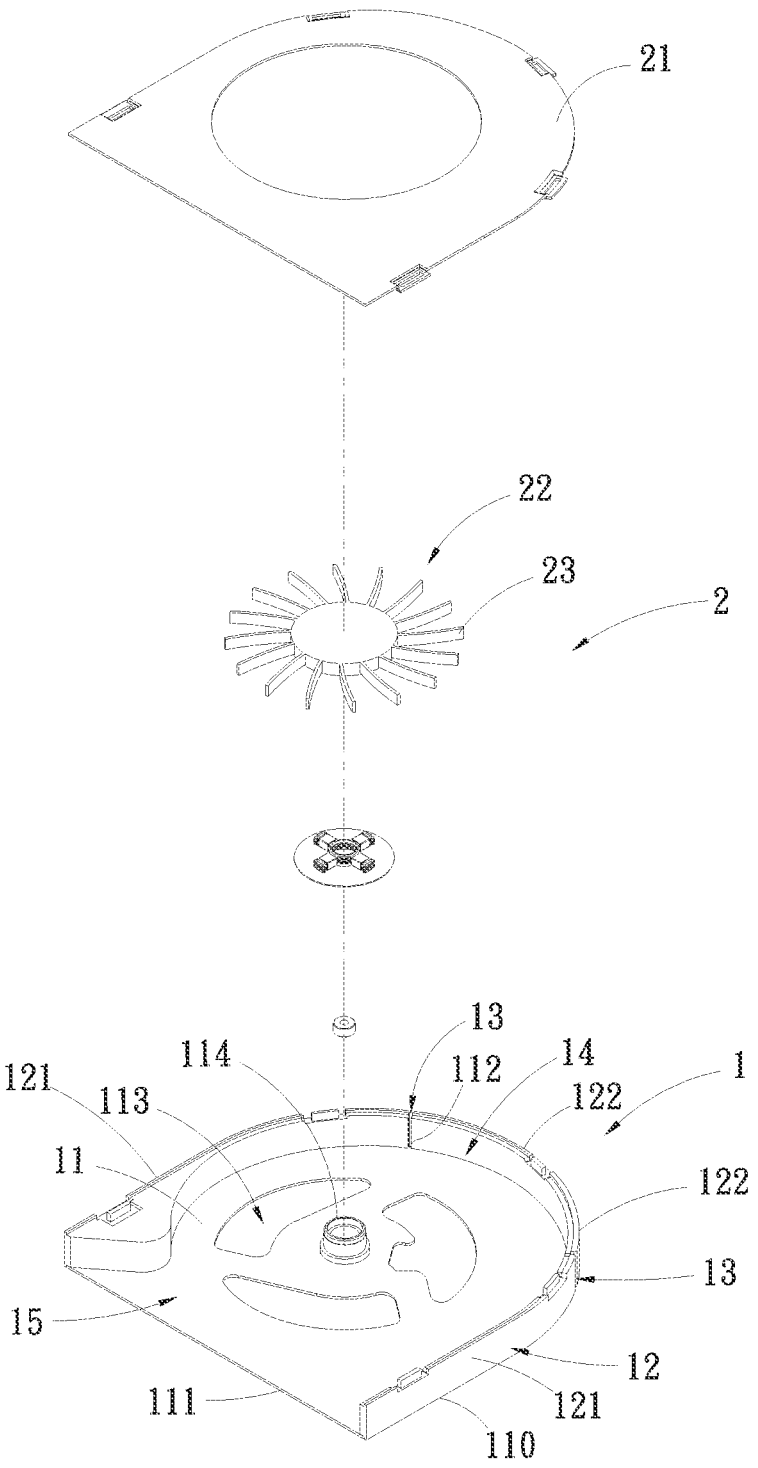
FIG. 3 is an exploded perspective view of a centrifugal fan using the fan frame structure of the present invention.

Please refer to FIGS. 1 and 2 along with FIG. 3. A centrifugal fan frame structure 1 for a centrifugal fan 2 includes a base plate 11 and a plurality of side wall sections 12. The base plate 11 is made of a metal material, such as stainless steel, aluminum, iron, titanium or any metal alloy. The base plate 11 includes a straight edge 111, a pair of lengthwise extended edges 110, a shaft barrel 114, an air inlet 113 and a curved edge 112. The curved edge 112 is extended from an end of one lengthwise extended edge 110 along an outer peripheral profile of the base plate 11 to an end of the other lengthwise extended edge 110. The straight edge 111 is connected at two ends to another ends of the lengthwise extended edges 110 at a right angle. The shaft barrel 114 is located at a central area of the base plate 11.

Alternatively, the shaft barrel 114 can be eccentrically located on the base plate 11. The centrifugal fan 2 has a fan wheel 22 including a plurality of blades 23, and the fan wheel 22 is rotatably mounted on the shaft barrel 114. The air inlet 113 is provided on the base plate 11 around an outer side of the shaft barrel 114 for guiding external air flow into the centrifugal fan 2.

The side wall sections 12 can be made of a plastic material or a metal material, and consist of a plurality of lengthwise extended side wall sections 121 and a plurality of curved side wall sections 122. The lengthwise extended side wall sections 121 and the curved side wall sections 122 together define a surrounding wall of the centrifugal fan frame structure 1. In the preferred embodiment, it is selected to form the lengthwise extended side wall sections 121 and the curved side wall sections 122 with a plastic material through an integral injection molding process, such that the lengthwise extended side wall sections 121 and the curved side wall sections 122 are associated with the lengthwise extended edge 110 and the curved edge 112 of the base plate 11, respectively. More specifically, the side wall sections 12 include several discontinuously arranged sections formed through insert molding (i.e. integral plastic injection molding) to be associated with the lengthwise extended edge 110 and the curved edge 110 of the base plate 11 to complete the centrifugal fan frame structure 1. Further, any two adjacent curved side wall sections 122 are spaced from one another by a clearance 13. It is noted portions of the curved edge 112 located corresponding to the clearances 13 are not covered by the insert molded curved side wall sections 122, and any two adjacent curved side wall sections 122 are not connected to each other. The clearances 13 among the side wall sections 12 provide the injection molded side wall sections 12 with sufficient expansion allowance. With this arrangement, it is able to prevent the side wall sections 12 from compressing the base plate 11 when the plastic molding material of the side wall sections 12 expands after the injection molding; and a wrapping force produced by the insert molding plastic material can be effectively reduced to minimize deformation of the base plate 11 caused by the wrapping force.

The side wall sections 12 and the base plate 11 together define a receiving space 14 and an air outlet 15. The receiving space 14 is communicable with the air inlet 113 and the air outlet 15. The shaft barrel 114 and the fan wheel 22 mounted thereon are located in the receiving space 14. Further, the base plate 11 and the side wall sections 12 can be made of the same material or be made of different materials.

In practical implementation of the present invention, the side wall sections 12 of the centrifugal fan frame structure 1 are connected at respective upper side to a top plate 21 of the centrifugal fan 2. Therefore, when the centrifugal fan 2 uses the centrifugal fan frame structure 1 of the present invention, the fan wheel 22 of the centrifugal fan 2 and the blades 23 provided on the fan wheel 22 can maintain at a fixed axial distance away from the base plate 11 to effectively ensure stable performance of the centrifugal fan 2.

In the present invention, since the side wall sections 12 formed through the injection molding process are actually separated into several spaced sections, which are connected to an outer periphery of the base plate 11 to complete the centrifugal fan frame structure 1, the wrapping force applied by the injection molded side wall sections 12 to the base plate 11 can be effectively reduced to prevent the base plate 11 against structural deformation and accordingly, to effectively prevent the entire fan frame structure 1 from deformation in the process of injection molding.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A centrifugal fan frame structure, comprising a base plate and a plurality of side wall sections, the base plate and the side wall sections together defining a receiving space; the base plate being made of a metal material and having a pair of opposing side edges, a curved edge, and an air outlet edge opposite the curved edge, the side wall sections being formed immediately adjacent each other along each of the pair of opposing side edges and the curved edge of the base plate through integral plastic injection molding to form a wall surrounding the receiving space with an opening along the air outlet edge, an expandable slit being formed between any two adjacent side wall sections, and wherein portions of the opposing side edges and the curved edge of the base plate located corresponding to the expandable slits are not covered by any injection molded side wall section;

wherein the expandable slits reduce a wrapping force produced by an insert molding plastic material, minimize deformation of the base plate caused by the wrapping force, and accommodate molding shrinkage during the integral plastic injection molding.

2. The centrifugal fan frame structure as claimed in claim 1, wherein the side wall sections include a plurality of lengthwise extended side wall sections and a plurality of curved side wall sections.

3. The centrifugal fan frame structure as claimed in claim 1, wherein the side wall sections are made of a plastic material.

4. A frame for a centrifugal fan, the frame comprising:

a planar base plate having a pair of opposing side edges, a curved edge extending between the side edges, and an air outlet edge opposite the curved edge and extending between the opposing side edges; and a plurality of plastic injection molded side wall sections arranged immediately adjacent each other and extending along the entirety of the opposing side edges and the curved edge of the base plate, thereby forming a wall surrounding a fan receiving space with an air outlet opening along the air outlet edge, each side wall section being independent from each other side wall section and separated from each adjacent side wall section by one of a plurality of expandable slits, wherein a corresponding portion of the side edge or curved edge of the base plate is exposed through each expandable slit;

whereby the expandable slits function during plastic injection molding of the side wall sections to reduce a wrapping force, minimize deformation of the base plate caused by the wrapping force, and accommodate molding shrinkage.

5. The frame of claim 4, wherein the plurality of side wall sections includes a plurality of elongate side wall sections and a plurality of curved side wall sections.

6. The frame of claim 4, further comprising a planar top plate disposed spaced-apart from the base plate and attached to each one of the plurality of side wall sections.

* * * * *